US007900487B2

(12) United States Patent
Lim

(10) Patent No.: US 7,900,487 B2
(45) Date of Patent: Mar. 8, 2011

(54) MECHANICAL APPARATUS FOR WASHING/DRYING

(75) Inventor: Hee Tae Lim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 513 days.

(21) Appl. No.: 11/760,102

(22) Filed: Jun. 8, 2007

(65) Prior Publication Data

US 2007/0289339 A1 Dec. 20, 2007

(30) Foreign Application Priority Data

Jun. 9, 2006 (KR) ..... 10-2006-0052038

(51) Int. Cl.
*D06F 37/20* (2006.01)

(52) U.S. Cl. ..... 68/23.1; 68/140

(58) Field of Classification Search ..... 68/23.1, 68/23.3, 140

See application file for complete search history.

(56) References Cited

U.S. PATENT DOCUMENTS

| | | | | |
|---|---|---|---|---|
| 4,991,412 | A * | 2/1991 | Bauer et al. | 68/23.1 |
| 6,574,997 | B1 * | 6/2003 | Mayer et al. | 68/23.1 |
| 2004/0016266 | A1 * | 1/2004 | Hisano | 68/23.1 |
| 2006/0075791 | A1 * | 4/2006 | Seo et al. | 68/23.1 |
| 2007/0251278 | A1 * | 11/2007 | Barcha et al. | 68/23.3 |

FOREIGN PATENT DOCUMENTS

| | | | |
|---|---|---|---|
| CN | 2139134 | A | 7/1993 |
| CN | 1779022 | A | 5/2006 |
| DE | 2524592 | | 12/1976 |
| DE | 602 03 582 | | 2/2006 |
| FR | 2 384 995 | | 4/1977 |
| JP | 2006-61613 | A | 3/2006 |
| KR | 10-2004-0047223 | A | 6/2004 |

OTHER PUBLICATIONS

Chinese Office Action dated Apr. 3. 2009.
Korean Office Action dated Mar. 29, 2007 for Application No. 10-2006-0052038.
English translation of German Office Action dated Jul. 27, 2010.
Chinese Patent Gazette for Application 200710110260.4, dated Sep. 29, 2010.

* cited by examiner

*Primary Examiner* — Joseph L Perrin
(74) *Attorney, Agent, or Firm* — KED & Associates, LLP

(57) ABSTRACT

A mechanical apparatus for washing/drying is disclosed. Accordingly, the present invention provides a structure for damping and absorbing vibration of a tub in a washer or dryer. The present invention includes a tub accommodating water therein, a drum rotatably provided within the tub, a spring provided to elastically support the tub, and a damping means having one end rotatably connected to the tub by a hinge assembly and the other end connected to a shock-absorbing member fixed to a cabinet.

18 Claims, 8 Drawing Sheets

MECHANICAL APPARATUS FOR WASHING/DRYING

This application claims the benefit of the Korean Patent Application No. P2006-52038, filed on Jun. 9, 2006, which is hereby incorporated by reference as if fully set forth herein.

BACKGROUND OF THE INVENTION

1. Field of the Invention

The present invention relates to a mechanical apparatus for washing/drying, and more particularly, to a structure for damping and absorbing vibration of a tub in a washer or dryer.

2. Discussion of the Related Art

FIG. 1 is a structural diagram of a drum type washer according to a related art and FIG. 2 is a cross-sectional diagram of a damper of a drum type washer according to a related art.

Referring to FIG. 1 and FIG. 2, a drum type washer consists of a washing tub 2 provided within an exterior 1 of the drum type washer, a dewatering tub 3 provided within the washing tub 2 to accommodate a laundry 6 therein, a damper 4 provided between the exterior 1 and the washing tub 2 to support and fix the washing tub 2 thereto and reduce an amplitude of vibration of the washing tub 2, a spring 5 elastically provided to an upper space between the exterior 1 and the washing tub 2 to fix and support the washing tub 2, and a leg 7 provided beneath the exterior 1 to support the drum type washer.

The damper 4, as shown in FIG. 2, consists of an outer pipe 8 assembled to an outer circumference of the washing tub 2 to have a pipe shape, an inner cylinder 9 assembled to an inner circumference of the exterior 1 to reciprocate within the outer pope 8 by the vibration of the washing tub 2, and a lubricative member 10 provided between an inner circumferential part of the outer pipe 8 and an outer circumferential part of the inner cylinder 9 to generate a frictional force for alleviating the amplitude of the vibration of the washing tub 2.

After the laundry 6 has been loaded in the dewatering tub 3 provided with the washing tub 2, if a power is applied to the above-configured drum type washer, water is introduced into the washing tub. Once a prescribed quantity of the water is introduced, the dewatering tub 3 is rotated to wash the laundry 6.

After completion of the washing of the laundry 6, the laundry 6 is dewatered. In a transition state that a considerable force is instantly applied to the dewatering tub 3 in initiating the dewatering, the laundry 6 inclines to generate imbalance. While the imbalance is maintained, the dewatering tub 3 is rotated at high speed to perform the dewatering of the laundry 6. So, an amplitude of vibration of the washing tub 2 increases.

Yet, in a normal status, the dewatering tub 3 is smoothly rotated to perform the dewatering of the laundry 6, whereby the vibrational amplitude of the washing tub 2 decreases.

In order to reduce the vibrational amplitude generated from the washing tub 2 due to the imbalance attributed to the incline of the laundry 6 in the transition state for the dewatering initiation of the laundry 6, the damper 4 is provided between the exterior 1 and the washing tub 2 of the drum type washer. So, the vibrational amplitude of the washing tub 2 can be reduced.

The vibrational amplitude of the washing tub 2 is reduced by a vertical force N between an inner circumference of the outer pipe 8 and an outer circumference of the inner cylinder 9 reciprocated within the outer cylinder 8 by the vibrational amplitude of the washing tube 2 or by a frictional force FN with the lubricative member 10 provided to increase the coefficient of friction.

Yet, the above-configured damper of the related art is hinged to both of the tub and the cabinet and has an excessively large incline angle. So, it is unable to effectively reduce or absorb the tub vibration in a lateral direction.

A damping force of the above-configured damper of the related art is about 70~120N to minimize a displacement of transient vibration in initial dewatering. Yet, since the damping force is excessively large, it is unable to effectively reduce the vibration in entering normal dewatering in particular. So, most of the vibration is transferred to a floor on which the washer including the cabinet is installed.

In this case, if the damping force of the related art damper is reduced to decrease the transferred force of the vibration, the displacement in the transient vibration is increased to cause a problem.

To effectively reduce the vibration of the normal dewatering as well as the vibration of the initial dewatering and to minimize the displacement of the tub, a damping means having a new configuration is needed.

Besides, the damping means is applicable to a dryer, for which tub vibration needs to be reduced, as well as a washer.

A dryer is a well-known mechanical device for drying laundry and its details will be omitted in the following description.

SUMMARY OF THE INVENTION

Accordingly, the present invention is directed to a mechanical apparatus for washing/drying that substantially obviates one or more problems due to limitations and disadvantages of the related art.

An object of the present invention is to provide a washer or dryer, by which a damping means differing from a related art damper in configuration is provided to effective reduce vibration in normal dewatering as well as transient vibration in initial dewatering and minimize a displacement of a tub.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a mechanical apparatus for washing/drying according to the present invention includes a tub accommodating water therein, a drum rotatably provided within the tub, a spring provided to elastically support the tub, and a damping means having one end rotatably connected to the tub by a hinge assembly and the other end connected to a shock-absorbing member fixed to a cabinet.

Thus, one end of the damping means is hinged to the tub, whereas the other end is connected to the fixed shock-absorbing member. When the tub vibrates horizontally or vertically, the vibration is buffered by the shock-absorbing member and damped by the damping means.

Since the related art damper is hinged to the cabinet and the tub, it is difficult to effectively restrict a lateral motion of the tub and the damping effect is insufficient.

Yet, in the present invention, since the damping means is fixed to the fixed shock-absorbing member, a lateral motion of the tub can be effectively restricted and damped. If the tub moves in a lateral direction, the damping means connected to the tub is turned centering on the other end connected to the shock-absorbing member. In doing so, the shock-absorbing member is bent to perform shock absorbing.

In the related art, since both end of the damper are rotatably hinged, it is unable to provide the shock-absorbing effect attributed to the bending action. So, it is difficult to buffer the lateral motion of the tub. Besides, the related art damper connection having the 4-pint link structure is unable to restrict the lateral motion of the tub correctly.

Preferably, the spring is provided to support an upper part of the tub. The spring is needed since it is not enough for the tub to be supported by the damping means only.

Preferably, the spring is loaded in the damping means. If the tub is supported by the damping means only, it is unable to place the tub at a correct position. So, the spring is necessary. Although the spring can be provided separate from the damping means, it can be loaded in the damping means.

Preferably, the shock-absorbing member includes a rubber bushing. And, the rubber bushing is fixed to the cabinet via a bracket. More preferably, the bracket has one end connected to a circumference of the rubber bushing and the other end fixed to the cabinet. So, the connection via the bracket provides additional shock absorbing attributed to the elastic power of the bracket.

Preferably, the rubber bushing is provided with a passing hole. And, the damping means includes an upper support part supporting a topside of the rubber bushing, a lower support part supporting a bottom side of the rubber bushing, and a connecting part inserted in the passing hole to connect the upper and lower supports parts.

More preferably, the rubber bushing is compressed and installed between the upper and lower support parts. Thus, if the rubber bushing is installed by being compressed, it is able to sustain the contacts between the rubber bushing and the support parts. And, it is also able to solve the problem of the loosened connection between the rubber bushing and the damping means.

As the rubber bushing is in a compressed state, compressive stress is applied to its inside. The compressive stress plays a role in preventing the crack generation of the rubber bushing. Weight is repeatedly applied to the rubber bushing by the tub vibration, which may cause fatigue breakage. Yet, if the rubber bushing is assembled in the compressive state, the compressive stress prevents the crack generation to extend a usable duration of the rubber bushing.

More preferably, the hinge assembly includes a hinge bracket having a fixing projection rotatably inserted in a fixing hole provided to the tub. In this case, the fixing projection is rotatable. So, the fixing projection is inserted in the fixing hole and then rotated to prevent its separation from the fixing hole.

And, the hinge bracket can include a hinge pin rotatably connecting the damping means. In this case, a rubber bushing is preferably provided between the damping means and the hinge pin.

More preferably, the hinge bracket has a separable configuration. In this case, the hinge bracket includes a first bracket and a second bracket assembled together to facilitate a connection between the damping means and the hinge pin.

For instance, the hinge pine is formed in one body of the first and second brackets. After the hinge pin has been inserted in an insertion hole provided to the damping means, the first and second brackets are assembled together to achieve the hinge connection with the damping means.

By inserting the rubber bushing between the hinge pin and the damping means and by forming the hinge pin in one body of the hinge bracket, it is able to prevent abrasion of the hinge pin. If the hinge pin abrades, the connection with the damping means is loosened to cause noise.

Preferably, the damping means includes a left damper connected to a left side of the tub in front of a weight center of the tub, a right damper connected to a right side of the tub to oppose the left damper, and a rear center damper connected to a center side of the tub in rear of the weight center of the tub.

In this case, if the spring is provided over the tub to support, it is able to omit the rear center damper. The spring hangs the tub to support and both of the left and right dampers can support the lower part of the tub.

If the spring supporting the upper part of the tub is omitted, the rear center damper is necessary. In this case, it is preferable that the spring is loaded in each of the dampers. In this case, it is preferable that the spring loaded in the rear center damper is greater than that of the rest of the dampers.

In this case, a damping force of each of the left and right dampers is preferably equal to or smaller than 20N. In the related art, the damping force of the damper is excessively large to increase the transfer force of the vibration to the cabinet from the tub.

And, each of the left and right dampers preferably inclines within 10° in a vertical direction. Moreover, the rear center damper can be vertically installed.

In another aspect of the present invention, a mechanical apparatus for washing/drying includes a cabinet, a tub provided within the cabinet to accommodate water therein, a damping means for supporting the tub by connecting the tub and the cabinet, a hinge assembly rotatably connecting the damping means to the tub, and a shock-absorbing member connecting to fix the damping means to the cabinet.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
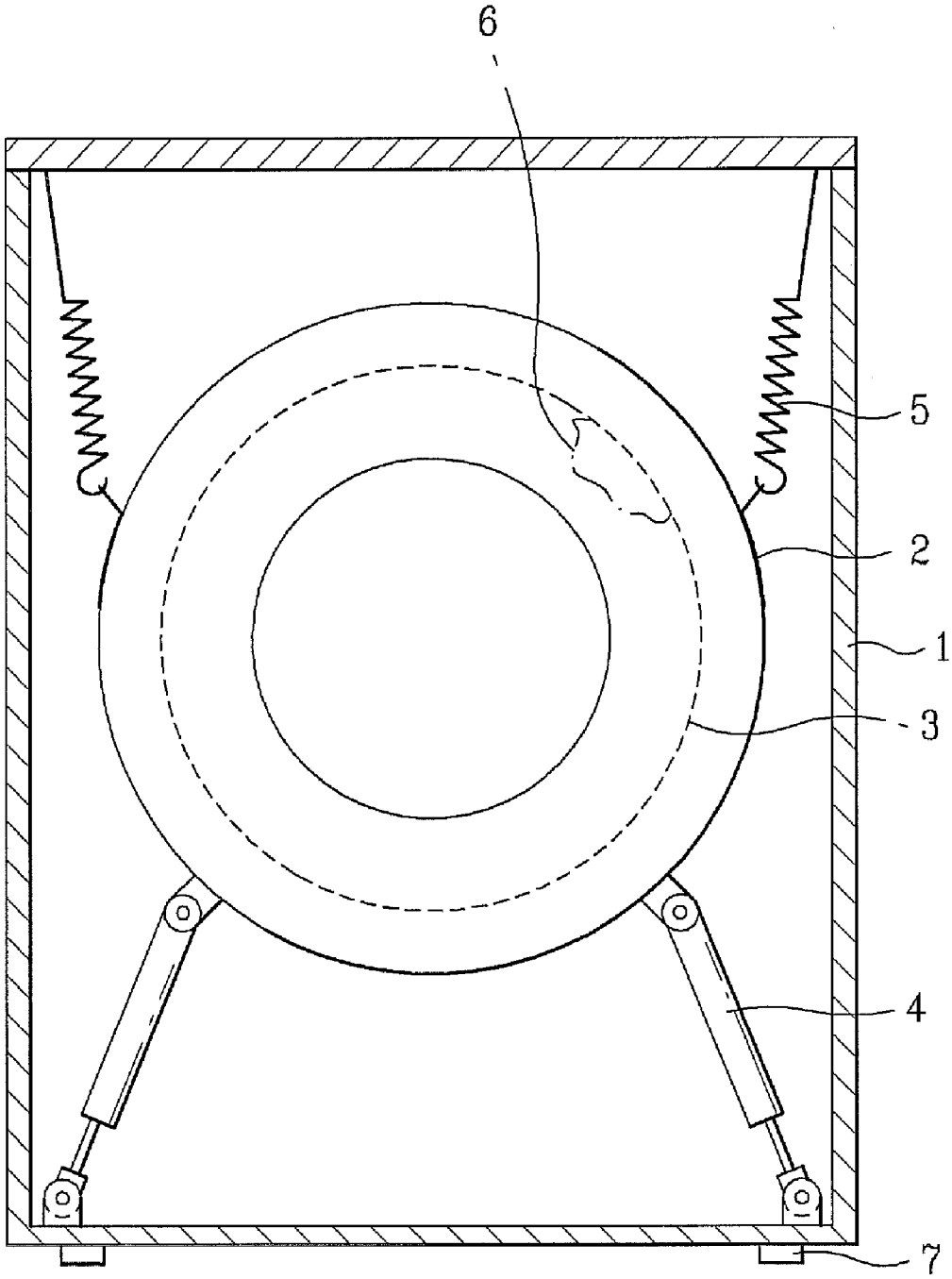
FIG. 1 Related Art
FIG. 1 is a structural diagram of a drum type washer according to a related art.
Figure 2:
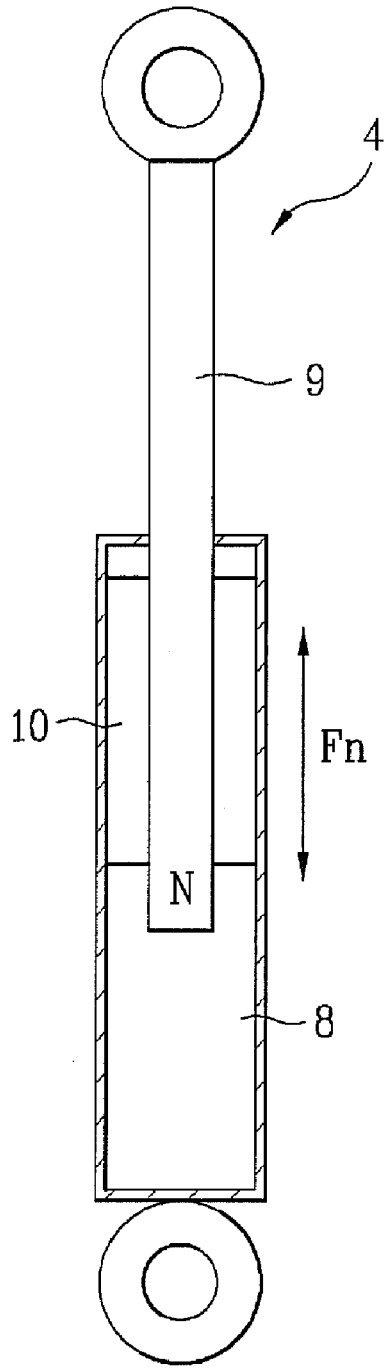
FIG. 2 Related Art
FIG. 2 is a cross-sectional diagram of a damper shown in FIG. 1.
Figure 3:
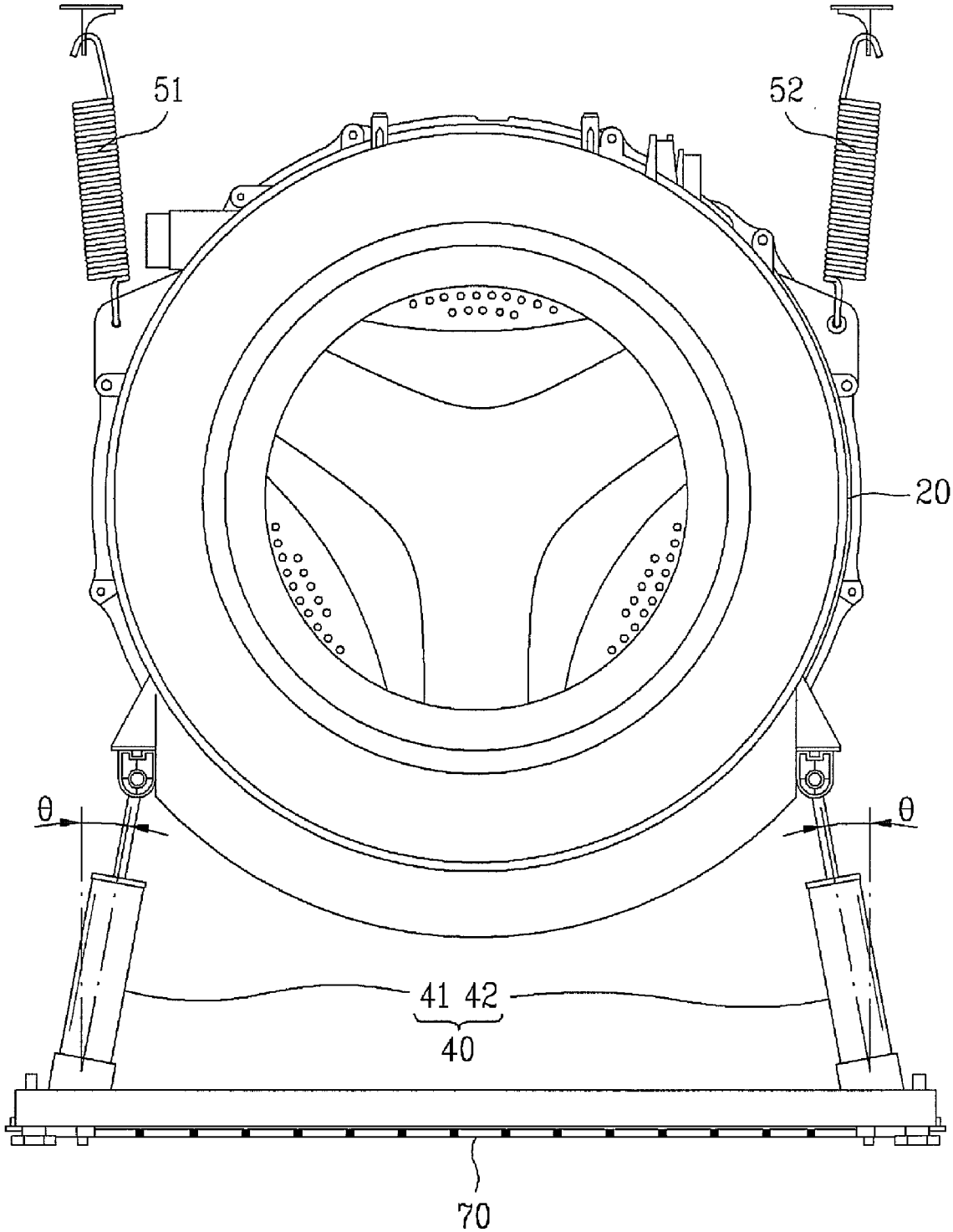
FIG. 3 and FIG. 4 are diagrams of preferred embodiments of the present invention.

FIG. 3 shows a first preferred embodiment of the present invention.

Referring to FIG. 3, a left spring 51 and a right spring 52 support an upper part of a tub 20. And, a left damper 41 and a right damper 42 support a lower part of the tub 20.

The dampers 41 and 42 are rotatably hinged to the tub 20 and connected to a base 70 of a cabinet via a shock-absorbing member. And, each of the left and right dampers 41 and 41 inclines toward a center of the tub 20 at an angle θ against a vertical direction. In the first embodiment of the present invention, the θ is 5~10°.

Figure 4:
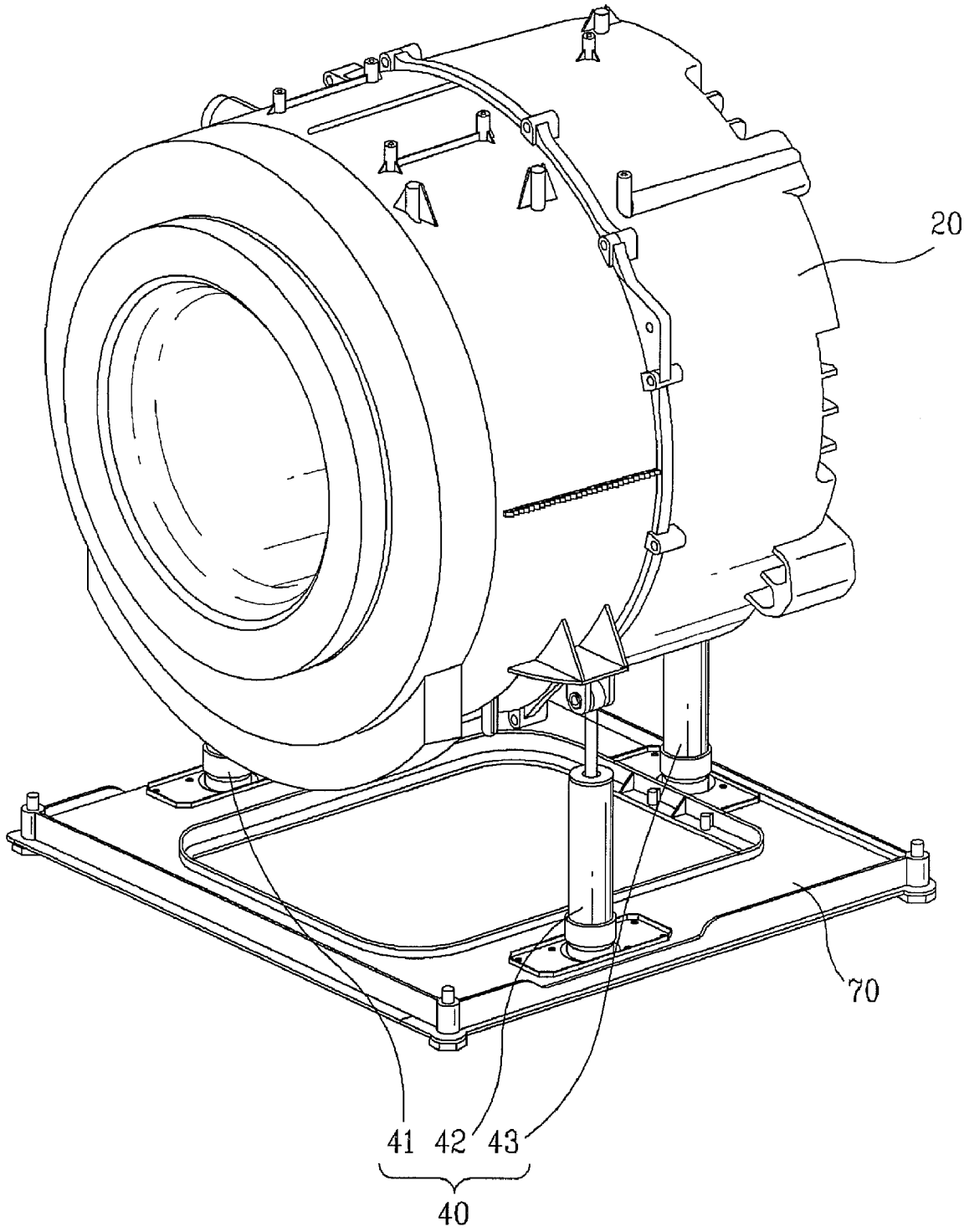

FIG. 4 shows a second preferred embodiment of the present invention.

Referring to FIG. 4, a spring 116 elastically supporting a tub 20 is loaded in a damper 41~43. And, the damper includes a left damper 41, a right damper 42, and a rear center damper 43.

The left and right dampers 41 and 42 are placed in front of a center of the tub 20. The springs 51 and 52 in FIG. 3 and the rear center damper 43 in FIG. 4 are provided in rear of the center of the tub 20.

And, the rigidity of the spring 116 of the rear center damper 43 is greater than that of the spring 116 of each of the left and right dampers 41 and 42.

Like the embodiment shown in FIG. 3, the left and right dampers 41 and 42 of the embodiment shown in FIG. 4 are configured to incline. Yet, the rear center damper 43 is vertically installed.

Figure 5:
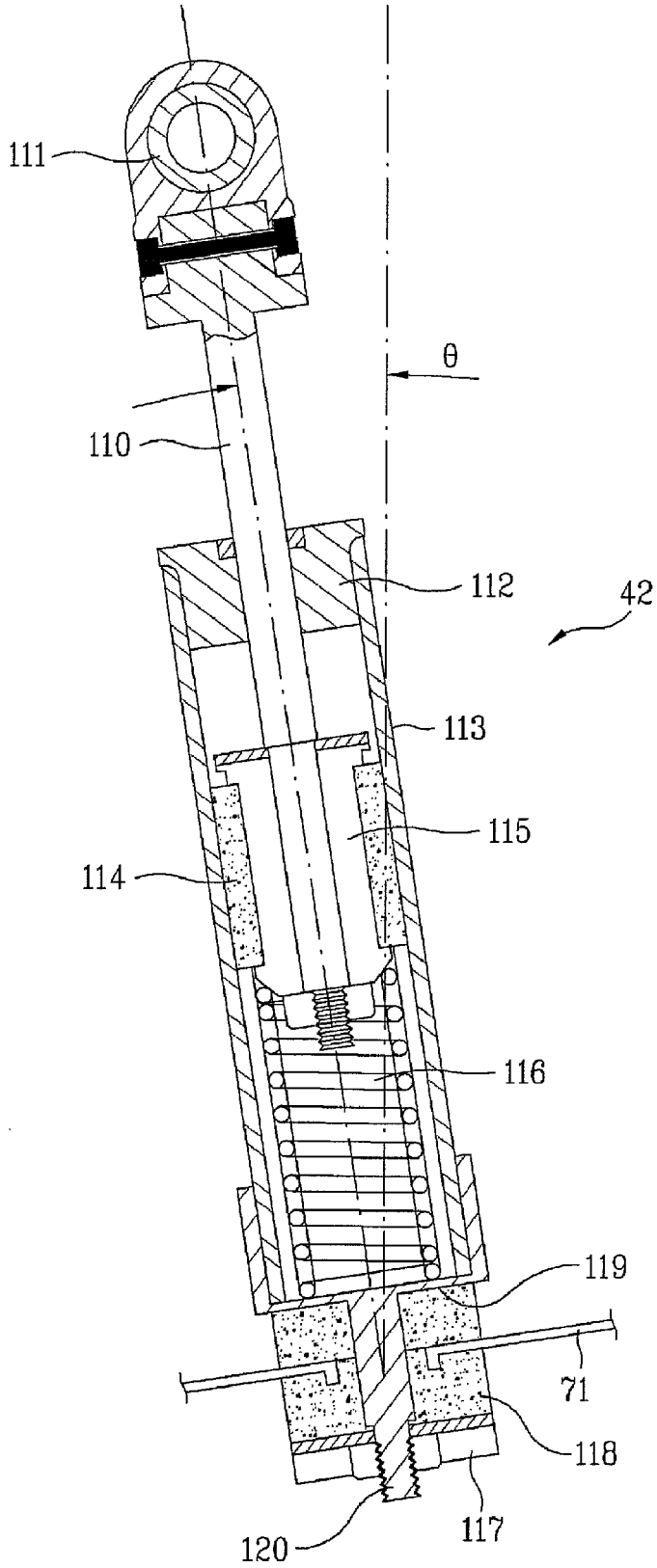
FIG. 5 is a cross-sectional diagram of a damper shown in FIG. 4.

FIG. 5 shows an internal configuration of the right damper 42 shown in FIG. 4, which is identically applicable to the left damper 41 or the rear center damper 43.

Besides, the former dampers 41 and 42 shown in FIG. 3 have the same damper configuration shown in FIG. 5 except that the spring 116 is excluded.

Referring to FIG. 5, a damper includes a piston 115, a piston rod 110, a cylinder 113 accommodating the piston 115 and the piston rod 110 therein, and a spring 116 provided within the cylinder 113 to support the piston 115.

And, a friction ring 114 is provided to a circumference of the piston 115. So, the friction ring 114 slides up and down on an inner wall of the cylinder 113 to perform a damping action.

The piston 115 partitions an internal space of the cylinder into an upper space and a lower space. A communicating hole (not shown in the drawing) can be provided to the piston 115 to enable the upper and lower spaces to communicate with each other.

Optionally, another communicating hole (not shown in the drawing) can be provided to the cylinder 113 to enable the upper and lower spaces to communicate with an external environment.

Optionally, the internal space of the cylinder 11 can be filled with such liquid as oil and the like. Fluid such as air and the like within the internal space of the cylinder 113 performs damping and shock absorbing together with the friction ring 114.

The piston rod 110 is guided by a guide part 112 formed of a plastic based material on the cylinder 113.

A hole is provided to an upper part of the piston rod 110 to enable a hinge pin 134 to be inserted therein. And, a rubber bushing 111 is fitted into the hole.

Meanwhile, the damper is connected to the cabinet base 70 via a shock-absorbing member such as a rubber bushing 118 shown in FIG. 5.

A bracket 71 is assembled to a circumference of the rubber bushing 118 and fixed to the cabinet base 70 as well.

A passing hole is formed in the rubber bushing 118. And, a connecting part 120 of the damper is inserted in the passing hole. A topside of the rubber bushing 118 contacts with an upper support part 119 of the damper to be supported and a bottom side of the rubber bushing 118 contacts with a lower support part 118 of the damper to be supported. And, the lower and upper support parts 118 and 119 are connected to each other by the connecting part 120.

The rubber bushing 118 is compressed and installed between the lower and upper support parts 118 and 119.

Figure 6:
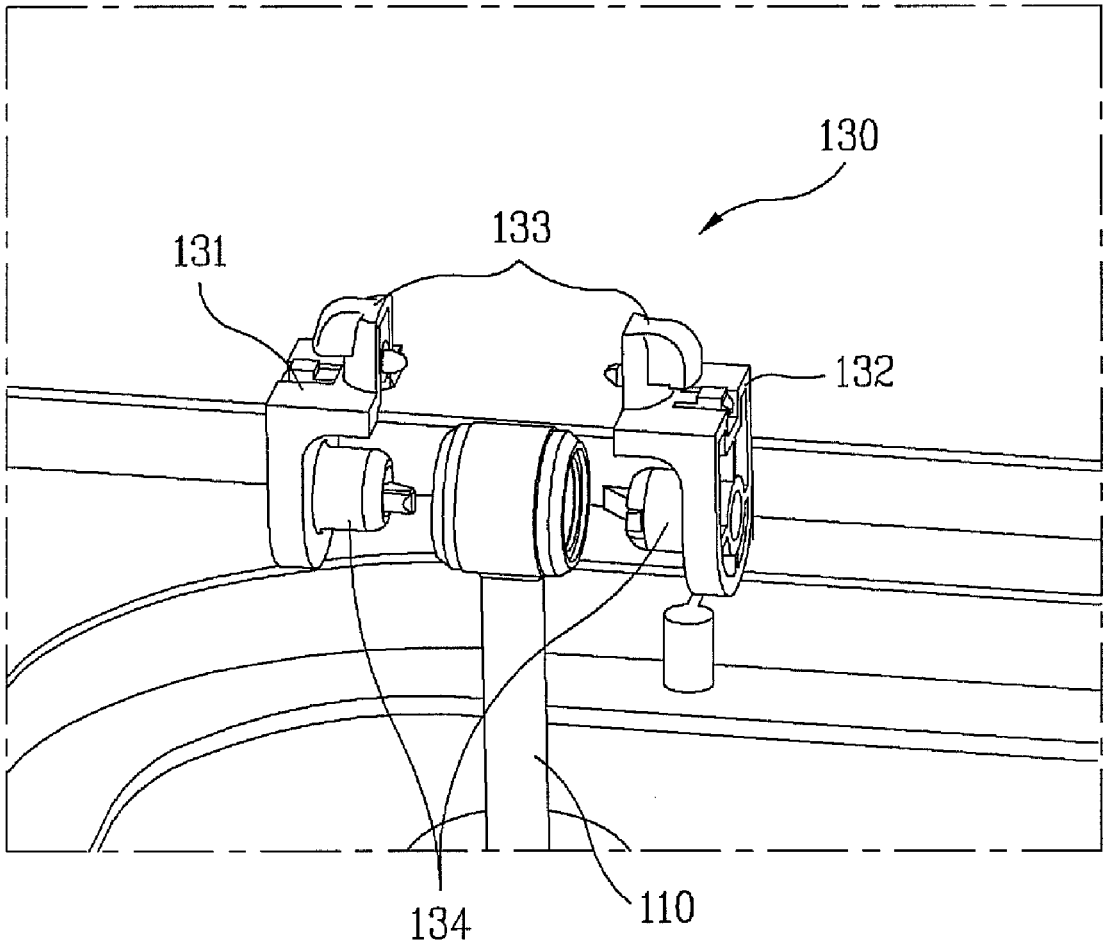
FIGS. 6 to 8 are diagrams of a hinge connection of a damper.
Figure 7:
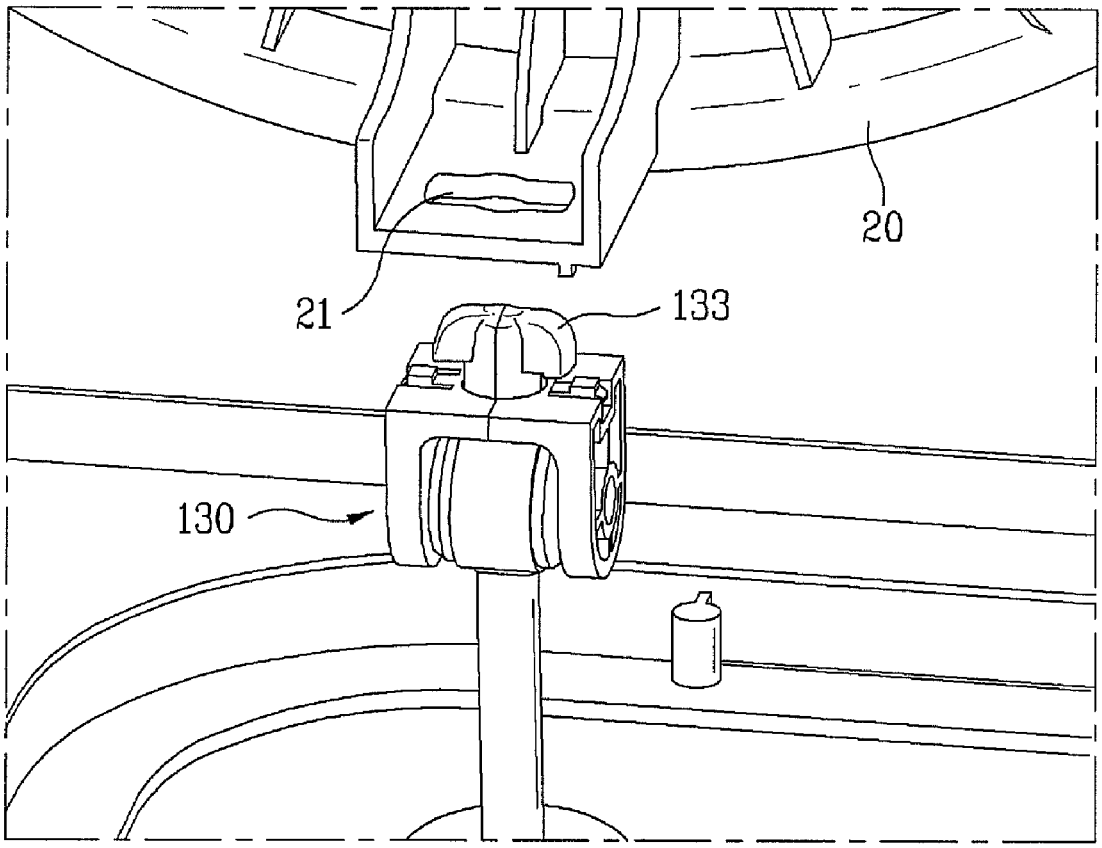

The hinge assembly between the damper and the tub 20 is explained with reference to FIGS. 6 to 8 as follows.

First of all, the tub 20 and the damper are rotatably connected together by a hinge assembly.

In this case, the hinge assembly includes a hinge bracket 130. The hinge bracket includes a first hinge bracket 131 and a second hinge bracket 132 assembled together by a hook locking. In particular, a half portion of a hinge pin 134 is built in one body of each of the first and second hinge brackets 131 and 132.

And, the hinge bracket 130 is provided with a fixing projection 133 inserted in a fixing hole 21 of the tub 20. In this case, the fixing projection 133 is rotatable.

Figure 8:
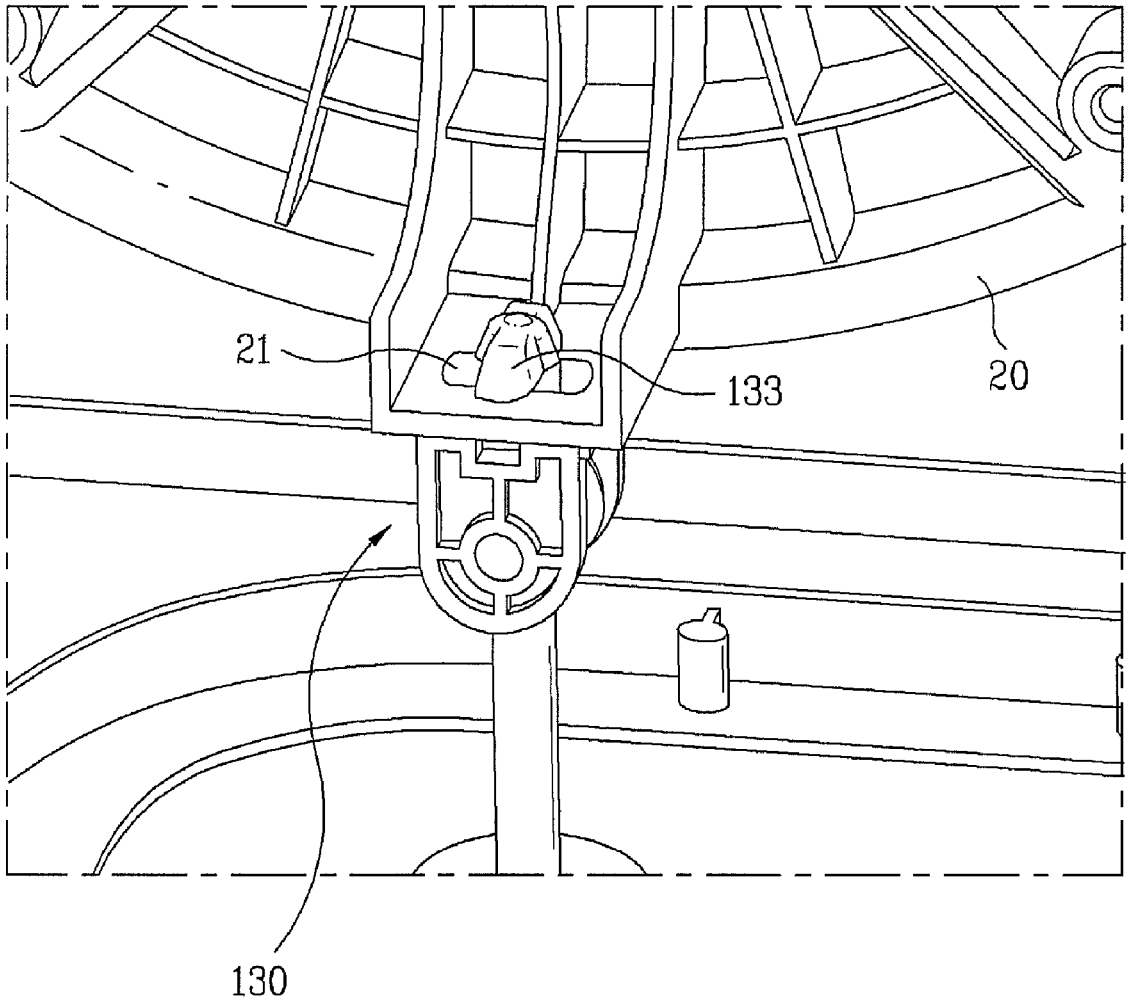

So, after the fixing projection 133 has been inserted in the fixing hole 21 of the tub 20, it is turned by 90° to provide the status shown in FIG. 8. Hence, the hinge bracket 130 and the damper are prevented from being separated from the tub 20.

In particular, a half portion of the fixing projection 133 is provided to each of the first and second hinge brackets 131 and 132. And, the half portions of the fixing projection 133 have a hook-locking configuration.

After the hinge pin 134 has been inserted in the upper part of the piston rod 110, the first and second hinge brackets 131 and 132 are assembled together. The fixing projection 133 is inserted in the fixing hole 21 of the tub 20 and then turned by 90° to be prevented from being separated from the tub 20.

Preferably, a stopper is provided to the tub 20 to prevent the fixing projection 133 from being turned over 90°. More preferably, the stopper can include a projection enough to interrupt the rotation of the fixing projection 133.

In the above-configured mechanical apparatus according to the present invention, when the drum is rotated to make the tub vibrate, the piston of the damper slides within the cylinder to perform the damping action while the rubber bushing as the shock-absorbing member buffers the bending of the damper to reduce the vibration.

Accordingly, the present invention provides the following effects or advantages.

First of all, the present invention provides a damping means having a configuration differing from that of the related art, thereby reducing vibration in normal dewatering as well as transient vibration in initial dewatering effectively. And, the present invention is able to minimize a displacement of a tub as well.

Secondly, the vibration transferred from a tub downwardly is minimized. And, vibration and noise caused to an installation place are considerably reduced. Hence, a silent operation is available.

Thirdly, the present invention prevents a walking phenomenon that a mechanical apparatus rocks or shakes in case of transient vibration.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A mechanical apparatus for washing/drying, comprising:

a tub accommodating water therein, the tub including a fixing hole;

a drum rotatably provided within the tub;

a spring provided to elastically support the tub; and a damping means having one end rotatably connected to the tub by a hinge assembly and the other end connected to a shock-absorbing member fixed to a cabinet, wherein the hinge assembly includes a hinge bracket rotatably connected to the damping means and having a fixing projection, the fixing projection being inserted in the fixing hole and then rotated to prevent its separation from the fixing hole, such that the fixing projection connects the hinge assembly to the tub.

2. The mechanical apparatus of claim 1, wherein the spring is provided to support an upper part of the tub and wherein the damping means comprises a left damper connected to a left side of the tub in front of a weight center of the tub and a right damper connected to a right side of the tub to oppose the left damper.

3. The mechanical apparatus of claim 1, wherein the spring is loaded in the damping means.

4. The mechanical apparatus of claim 1, wherein the shock-absorbing member comprises a rubber bushing and wherein the mechanical apparatus further comprises a bracket having one end connected to a circumference of the rubber bushing and the other end fixed to the cabinet.

5. The mechanical apparatus of claim 4, wherein the rubber bushing is provided with a passing hole and wherein the damping means comprises an upper support part supporting a topside of the rubber bushing, a lower support part supporting a bottom side of the rubber bushing, and a connecting part inserted in the passing hole to connect the upper support part and the lower support part.

6. The mechanical apparatus of claim 5, wherein the rubber bushing is compressed and installed between the upper support part and the lower support part.

7. The mechanical apparatus of claim 1, wherein a stopper is provided to the tub to stop a rotation of the fixing projection.

8. The mechanical apparatus of claim 1, wherein the hinge bracket includes a hinge pin rotatably connecting the damping means.

9. The mechanical apparatus of claim 8, wherein the hinge bracket comprises a first bracket and a second bracket assembled together to facilitate a connection between the damping means and the hinge pin.

10. The mechanical apparatus of claim 1, wherein the damping means comprises:

a left damper connected to a left side of the tub in front of a weight center of the tub;

a right damper connected to a right side of the tub to oppose the left damper; and a rear center damper connected to a center side of the tub in rear of the weight center of the tub.

11. The mechanical apparatus of claim 10, wherein a damping force of each of the left and right dampers is equal to or smaller than 20N.

12. The mechanical apparatus of claim 11, wherein each of the left and right dampers inclines within 10° in a vertical direction.

13. The mechanical apparatus of claim 10, wherein a damping force of the rear center damper is greater than that of each of the left and right dampers.

14. A mechanical apparatus for washing/drying, comprising:

a cabinet;

a tub provided within the cabinet to accommodate water therein;

a damping means for supporting the tub by connecting the tub and the cabinet;

a hinge assembly rotatably connecting the damping means to the tub; and a shock-absorbing member connecting to fix the damping means to the cabinet, wherein the hinge assembly includes a hinge bracket rotatably connected to the damping means and having a fixing projection, the fixing projection being inserted in a fixing hole and then rotated to prevent its separation from the fixing hole, such that the fixing projection connects the hinge assembly to the tub.

15. The mechanical apparatus of claim 14, further comprising a spring loaded in the damping means.

16. The mechanical apparatus of claim 14, wherein the hinge bracket includes a hinge pin that rotatably connects the damping means.

17. The mechanical apparatus of claim 14, wherein the shock-absorbing member comprises a rubber bushing and wherein the mechanical apparatus further comprises a bracket having one end connected to a circumference of the rubber bushing and the other end fixed to the cabinet.

18. The mechanical apparatus of claim 14, wherein the damping means comprises:

a left damper connected to a left side of the tub in front of a weight center of the tub;

a right damper connected to a right side of the tub to oppose the left damper; and a rear center damper connected to a center side of the tub in rear of the weight center of the tub.

* * * * *